United States Patent [19]

Green et al.

[11] Patent Number: 4,540,165

[45] Date of Patent: Sep. 10, 1985

[54] OPERATING TABLE

[75] Inventors: John F. Green, Burwood; Richard A. Morris, Elsternwick, both of Australia

[73] Assignee: Denyers Pty. Ltd., Victoria, Australia

[21] Appl. No.: 404,707

[22] Filed: Aug. 3, 1982

[30] Foreign Application Priority Data

Aug. 4, 1981 [AU] Australia ..... PF0049

[51] Int. Cl.[3] ..... A61G 13/00

[52] U.S. Cl. ..... 269/325

[58] Field of Search ..... 269/79, 203, 322, 323, 269/324, 325, 326, 328; 5/60, 62

[56] References Cited

U.S. PATENT DOCUMENTS 3,851,870 12/1974 Cook ..... 269/322

FOREIGN PATENT DOCUMENTS 425723 7/1972 Australia .

640539 5/1962 Canada ..... 269/322

*Primary Examiner*—Frederick R. Schmidt

*Assistant Examiner*—Judy J. Hartman

*Attorney, Agent, or Firm*—Stevens, Davis, Miller & Mosher

[57] ABSTRACT

An operating table including a support structure and an elongate table top mounted on the support structure. The table top is composed of four relatively movable sections arranged in edge to edge relationship with the adjacent edges of each two adjacent sections extending transverse of the longitudinal axis of the table top and each section being movable relative to its adjacent section about an axis also extending transverse to that longitudinal axis. One of the sections forms a first transferable or head section and is normally releasably mounted at one end of the table. A second transferable or leg section is normally releasably mounted at the opposite end of the table. The leg section includes a coupling hole at the outer end thereof so that the head section can be selectively releasably attached to the outer end of the leg section.

19 Claims, 4 Drawing Figures

OPERATING TABLE

This invention relates to operating tables of the kind having a table top divided into a plurality of sections.

Some known operating tables such as described in Australian Pat. No. 425,723 provide a relatively large clear area for transmission of X-rays enabling examination of a patient while the patient is on the table. One problem with existing operating tables is that X-ray examination of some portions of a patient's body is impossible due to opaque cross portions of the table unless the patient is moved to a new position. For example, in a foreign body search it is usually necessary to place the patient on a large specially constructed table which is transparent to X-rays and which is usually located in the radiology section of a hospital. When the foreign body is located the patient's skin is marked in the appropriate place and the patient is then transferred to a trolley so that the patient can be moved to an operating theatre and the patient is there transferred to the operating table. During such movement of the patient the foreign body can move substantially within the patient's body.

BACKGROUND OF THE INVENTION

Also it is impossible with known operating tables to scan the entire torso of the patient such as is desirable in urinary tract examination using radioactive tracers. This has also been the result of cross pieces provided in the table top being opaque to the radiation.

SUMMARY OF THE INVENTION

It is an object of the present invention to provide an operating table of a construction which enables the provision of a substantially increased surface area which is transparent to radiation used in patient examination or scanning.

According to the present invention there is provided an operating table including a support structure, an elongate table top mounted on said support structure, said table top being composed of a plurality of relatively movable sections arranged in edge to edge relationship, the adjacent edges of each two adjacent sections extending transverse of the longitudinal axis of said table top and each said section being movable relative to its adjacent section about an axis also extending transverse to that longitudinal axis, one of said sections forming a first transferable section and being normally located at one end of said table, releasable connecting means connecting said first transferable section to the adjacent said section, and further connecting means at the opposite end of said table top whereby said first transferable section can be releasably attached to either said end of the table top.

Preferably a second section forms a second transferable section and is normally located at the opposite end of said table top from said first transferable section; said operating table further comprising a second releasable connecting means connecting said second transferable section to its adjacent section. The second transferable section may be placed in the position first described for the first transferable section. The table top may be divided into two, three, four or more sections but in the preferred embodiment the table top is divided into four sections and it will be convenient to hereinafter describe the invention in relation to a table having four sections. Also it will be convenient to refer to the four sections as the first transferable or head, upper torso, lower torso and second transferable or leg sections respectively. In the preferred embodiment the head section is selectively removable from the upper torso section and can be transferred to the opposite end of the table top and be releasably attached to the leg section to thereby provide a cantilevered configuration with the lower torso, leg and head sections extending from one side of the support structure. Preferably also the leg section is selectively removable from the lower torso section enabling the leg section to be attached to the upper torso section when the head section has been removed, after which the head section can then be attached to the leg section. With this arrangement the head, leg and upper torso sections are cantilevered on the opposite side of the support structure.

The operating table according to the preferred embodiment of the invention may be generally conventional in construction insofar as the support structure is concerned. That is, the operating table may include a base member mounted on castors and an upright support column for supporting the table top. The support column may be telescopic to enable adjustment of the height of the table top and the telescopic operation of the support column may be provided by hydraulic drive means which is actuated by a foot pedal.

In the preferred embodiment the upper torso section is pivotally mounted to the upper portion of the support column in such a manner that the upper torso section is pivotally movable about a longitudinal axis and a transverse axis. Preferably the pivotal movement about the longitudinal and transverse axes are independent of each other. Preferably the remaining sections of the table top are mounted directly or indirectly to the upper torso section so that movement of the upper torso section about either of its pivotal axes moves the entire table top about the respective axis. For example the entire table top may be tiltable about a horizontal longitudinal axis extending generally along the mid-line of the elongated table top. Preferably the table top is tiltable about this axis to either side of the horizontal. A suitable tilting mechanism is described in Australian Patent Specification No. 425,723. However, preferably the mechanism for tilting the table top about the longitudinal axis is modified somewhat from that described in Patent Specification No. 425,723 so as to be operated from one side of the operating table. Actuation of the tilting mechanism from the side of the operating table is desirable since the table of the present invention can be modified in its configuration in the lengthwise direction and this would make it difficult to tilt the table if the tilting mechanism was operable from one end of the table.

The upper torso section is also preferably pivotal about a transverse axis so that raising and lowering of one end of the upper torso section relative to the other end can be achieved. Preferably the upper torso section is generally square or rectangular in plan and one longitudinal end of the upper torso section is pivotally mounted to the support column and the opposite end is movable about the pivoted end. The table preferably includes drive means for pivotally moving the upper torso section about the pivotally mounted end thereof. The drive means may be of any suitable construction. For example, the drive means may include a screw threaded shaft pivotally connected at one end to a portion of the support column. A nut may be threaded to the shaft and be connected to one end of a sleeve, the other end being geared to a drive shaft rotatably mounted so as to extend transversely of the upper torso section at the end remote from the pivoted end. The drive shaft may be provided with a crank arm and a drive handle. With this arrangement turning of the drive handle rotates the sleeve and thereby rotates the nut so that the threaded shaft moves relative to the nut and the upper torso section thereby is pivotally moved about its pivoted end.

In the normal configuration of the operating table according to the preferred embodiment of the present invention the head section is connected to the upper torso section and is capable of independent pivotal movement about a transverse axis relative to the upper torso section along their adjacent edges so as to selectively enable raising and lowering of the head portion. The lower torso section is pivotally mounted to the upper torso section and is capable of independent pivotal movement about a transverse axis relative to the upper torso section along their adjacent edges. Finally, the leg section is pivotally mounted to the lower torso section and is also capable of similar independent pivotal movement relative to the lower torso section.

In the preferred embodiment the head section comprises a generally "U" shaped frame, the base of the "U" being at the longitudinally outermost end of the table top. The two side frame members and the base of the "U" define between them a clear area enabling radiological examination of a patient lying with a portion of the patient's body on the head section. The upper surface of the table may be provided by a radiolucent surface plate connected to the side frame members and to the base of the "U".

The upper torso section preferably includes two parallel side frame members defining between them an open space enabling passage of radiation between the side frame members. As with the head section a radiolucent surface plate may be connected to the side frame members to define the top surface of the table. The head section in the normal configuration of the operating table is connected to the outer ends of the side frame members of the upper torso section while the inner ends of the side frame members are pivotally connected to the head piece of the support column.

The lower torso section also preferably comprises two generally parallel side frame members leaving an open space between them for passage of radiation. The inner ends of the parallel side frame members of the lower torso section are pivotally mounted to the upper torso section. The outer ends of the side frame members of the lower torso section are preferably connected by a radiolucent cross piece. The cross piece may be in the general form of a slat having its broad faces generally vertical. The radiolucent cross piece may be made of any suitable material such as Plexi glass or a polycarbonate plastics material. The cross piece is arranged to provide a degree of torsional stability to the lower torso section particularly in the cantilevered configuration of the operating table. With this construction of lower torso section the entire length of the lower torso section between the parallel side frame members is radiolucent and thus provides a greater surface for radiological examination than past operating tables using cross pieces which are opaque to radiation.

The leg section preferably includes two generally parallel side frame members leaving an open space which is transparent to radiation therebetween. The side frame members may support a surface plate which is transparent to radiation and which provides the top surface of the table. Normally the inner ends of the leg section side frame members are mounted to the lower torso section. As with the lower torso section, the outer ends of the leg section side frame members may be connected by a radiolucent cross piece so that the leg section also provides a continuous radiolucent area between the side frame members and extending from one longitudinal end to the other.

As mentioned above the lower torso section is preferably pivotally coupled to the upper torso section at each side so that the lower torso section is pivotably movable relative to the upper torso section. The operating table preferably includes drive means for effecting pivotal movement of the lower torso section relative to the upper torso section. Preferably the drive means is arranged to provide a positive drive to both sides of the lower torso section so that the table top has sufficient torsional stability particularly in its cantilevered configuration. In a possible arrangement of drive means each side frame member of the lower torso section has a drive arm extending downwardly below the axis of pivotal connection of the lower torso section to the upper torso section, the drive means including a drive mechanism provided on the upper torso section arranged to move the drive arms about the pivot axis.

The drive mechanism on the upper torso section preferably includes two drive screws mounted in suitable bearings, one screw at each side of the upper torso section. A follower nut is provided on each drive screw and each follower nut is drivably coupled to the respective drive arm of the lower torso section by means of a drive link. The drive link is pivotally connected to the follower nut and to the respective drive arm. With this arrangement as the drive screws are turned the follower nuts travel along the drive screws and the movement of the nuts is transmitted to the drive arms of the lower torso section thus pivotally moving the lower torso section relative to the upper torso section. The drive screws may be arranged to be operated by a drive shaft extending transversely of the upper torso section. One end of the drive shaft is provided with a crank handle. The drive shaft may be coupled to the drive screws by means of meshing helical gears provided on the drive shaft and the respective drive screws. If desired the same drive shaft used for effecting pivotal movement of the upper torso section relative to the head piece of the support column may be used for effecting pivotal movement of the lower torso section relative to the upper torso section. This may be achieved by providing a transversely movable drive shaft and associated crank handle, the drive shaft being movable between two laterally spaced operative positions in which the helical gears provided on the drive shaft mesh with either the gears for the drive screws of the lower torso section drive mechanism or with the nut sleeve of the upper torso section drive means.

The leg section of the operating table as mentioned above is preferably detachable from the lower torso section and may be fitted to the upper torso section. Accordingly, the leg section preferably includes coupling means enabling selective detachment of the leg section from the lower torso section. The coupling means in one embodiment comprises a pair of coupling pins, one at each side of the leg section and being arranged to fit into coupling holes provided in the longitudinal end face of the lower torso section. The coupling pins are preferably provided at the sides of the leg section so that no intrusion into the radiolucent space between the side frame members of the lower torso or leg sections occurs. The coupling pins may be necked at a portion thereof and retaining pins in the lower torso section may be arranged to releasably engage in the necked portions when the pins are inserted into the holes in the lower torso section and thereby securely retain the leg section to the lower torso section. The retaining pins may be spring biased into their operative retaining positions so that the leg section is a snap fit into the lower torso section. During detachment of the leg section the retaining pins are withdrawn against the action of the biasing springs and the coupling pins may then be withdrawn from the coupling holes.

In Australian Pat. No. 425,723 there is described a relatively simple pivoting and locking mechanism for the head and leg sections. In the table according to the present invention a more positive lock is desirable for the leg section since there will be a greater load on the leg section when the head section is connected to the end of the leg section in the cantilevered configuration of the operating table. Accordingly, the operating table according to the present invention preferably includes a locking mechanism at each side of the leg section, the locking mechanism being operative to positively lock the leg section in a chosen angular position relative to the lower torso section (in the normal configuration of the table). The locking mechanism is operable to enable pivoting of the leg section relative to the lower torso section whilst enabling secure locking of the leg section in a particular chosen angular position.

The locking mechanism may include two coupling brackets each of which is pivotally mounted at its upper end to the inner end of a respective side frame member of the leg section. The coupling pins extend from the coupling brackets for engagement in the coupling holes in the lower torso section. Each coupling bracket may also include a downwardly extending arm to which is pivotally connected a locking shaft. The locking shaft preferably extends in the longitudinal direction underneath the respective side frame member and is arranged to be positively held by a holding member to lock the leg section in a particular angular position.

The holding member may comprise a holding block which is slidable relative to the locking shaft, the locking shaft extending through the holding block. Preferably the holding block is biased to a locking position in which the shaft is held against movement relative to the holding block. In one suitable arrangement the locking shaft may be provided with a plurality of circumferential grooves or necked portions provided along a substantial portion of the length of the locking shaft, which grooves are arranged to be engaged by the holding member to lock the leg section in a particular angular configuration. In one suitable arrangement the holding block is provided with a pair of holding rollers which are movable in respective angled tracks in the holding block, the angled tracks being inclined towards the locking shaft away from the end of the leg section which is connected to the lower torso section so that the weight of the leg section tends to force the block along the locking shaft towards the pivoted end whereby the holding rollers are forced by the outer surfaces of the angled tracks towards the locking shaft and into the grooves provided therein.

For releasing the locking mechanism described above there may be provided a linkage arrangement between the holding block and a release means provided at the sides of the leg section. The release means preferably includes a release arm extending from each side of the leg section which is coupled through the linkage arrangement to the holding block and operable so that movement of the release arm draws the holding block back against the biasing means. When this occurs the inner surfaces of the angled tracks engage with the rollers to move them along the tracks away from the locking shaft thereby releasing the locking shaft and enabling pivotal movement of the leg section relative to the lower torso section.

The outer end of the leg section is preferably provided with a pair of coupling holes for receiving the head section and these coupling holes are of substantially the same configuration as those provided in the lower torso section.

The head section of the table according to the preferred embodiment of the present invention is selectively detachable from the upper torso section and may be provided with coupling means of substantially the same configuration as that described above for the leg section. That is, the head section may be provided with necked coupling pins which are arranged to engage in coupling holes provided in the end face of the upper torso section (in the normal configuration of the operating table) and also operative to engage in the coupling holes provided in the outer end of the leg section (in the cantilevered configuration of the operating table). The head section also preferably includes a pivoting mechanism for enabling independent pivoting movement of the head section relative to the adjacent section.

The pivoting mechanism may be simpler than that described for any of the other sections and may be provided at only one side of the head section since it is not expected that the head section will need to carry substantial loads unlike the other three sections. Accordingly, the pivoting mechanism preferably includes a downwardly extending arm at one side of the head section, the coupling pin at that side extending forwardly from the downwardly extending arm. At the lower end of the downwardly extending arm there may be pivotally connected a nut tube extending away from the coupling means and generally towards the longitudinally outermost end of the head section. The nut tube may be engaged by a screw threaded shaft which is drivable by an operating handle projecting from the outermost end of the head section. The operating handle may be coupled to the screw threaded shaft through a universal joint to allow limited angular movement of the screw threaded shaft relative to the operating handle. With this construction turning of the operating handle moves the screw threaded shaft into or out of the nut tube and thus pivots the head section relative to the section of the table.

BRIEF DESCRIPTION OF THE DRAWING

An operating table according to the preferred embodiment of the present invention is shown in the accompanying drawings. In FIG. 2 the radiolucent areas of the table top are shown hatched and it can be seen that the construction enables the entire head and torso of the patient to be scanned during a radiological examination without the need for moving the patient to avoid cross pieces which are opaque to radiation.

It will be appreciated that the specific constructional features showh in the accompanying drawings are not intended as limiting on the scope of the present invention, the drawings being merely intended as illustrative of one possible embodiment of the operating table.

DESCRIPTION OF THE PREFERRED EMBODIMENT

Figure 1:
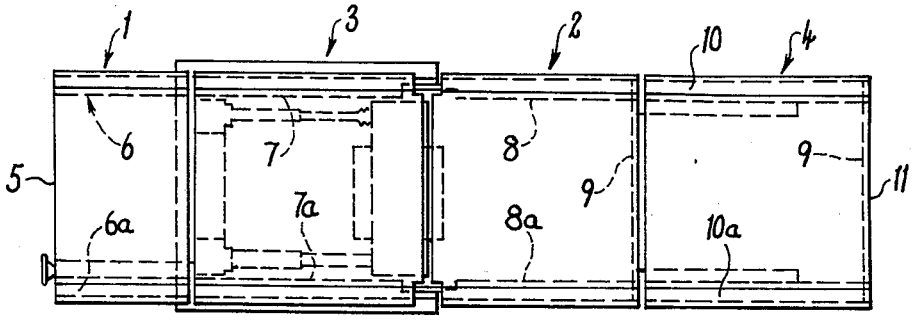
FIG. 1 shows a top plan view of the operating table in its normal configuration and FIG. 2 shows a top plan view of the operating table in its cantilevered configuration.

Considering now the drawings in more detail, and referring firstly to FIG. 1, the operating table in its normal configuration is divided into four sections arranged in order with a first transferable section 1 adjacent an upper torso section 3 which is in turn adjacent to a lower torso section 2 which in its turn is adjacent a second transferable section 4. The first transferable section normally provides support for the head. The second transferable section normally provides support for the legs. The head section 1 comprises a generally "U" shaped frame composed of two side frame members 6 and 6A and a base 5. The upper torso section 3 comprises two generally parallel side frame members 7 and 7A to which the side frame members of the head section are releasably attached. At its outer ends, the inner ends of the side frame members 7 and 7A of the upper torso portion are pivotally connected to the support structure (not shown). The lower torso portion in turn comprises two generally parallel side frame members 8 and 8A, the inner ends of which are pivotally connected to the upper torso portion 3, the outer ends being connected to a radiolucent cross piece 9 arranged to provide torsional stability to the lower torso section. The radiolucent cross piece 9 is in the general form of a slat and is shown, in dotted outline, in a generally vertical configuration when the table top is generally horizontal.

The leg section 4 includes two generally parallel side frame members 10 and 10A, the inner ends of which are mounted to the lower torso section; the outer ends being connected by a radiolucent cross piece 11.

Figure 2:
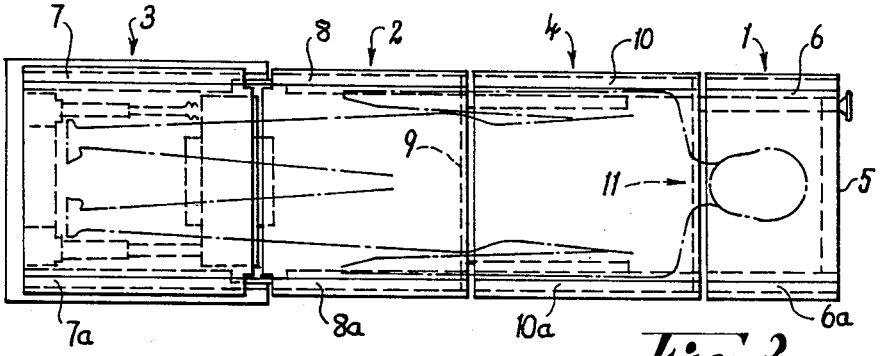

In FIG. 2 the operating table of FIG. 1 is showed in its cantilevered configuration. The first transferable section 1 is attached to the outer end of the second transferable section 4. The parts of the operating table are marked with the same numerals as in FIG. 1.

Figure 3:
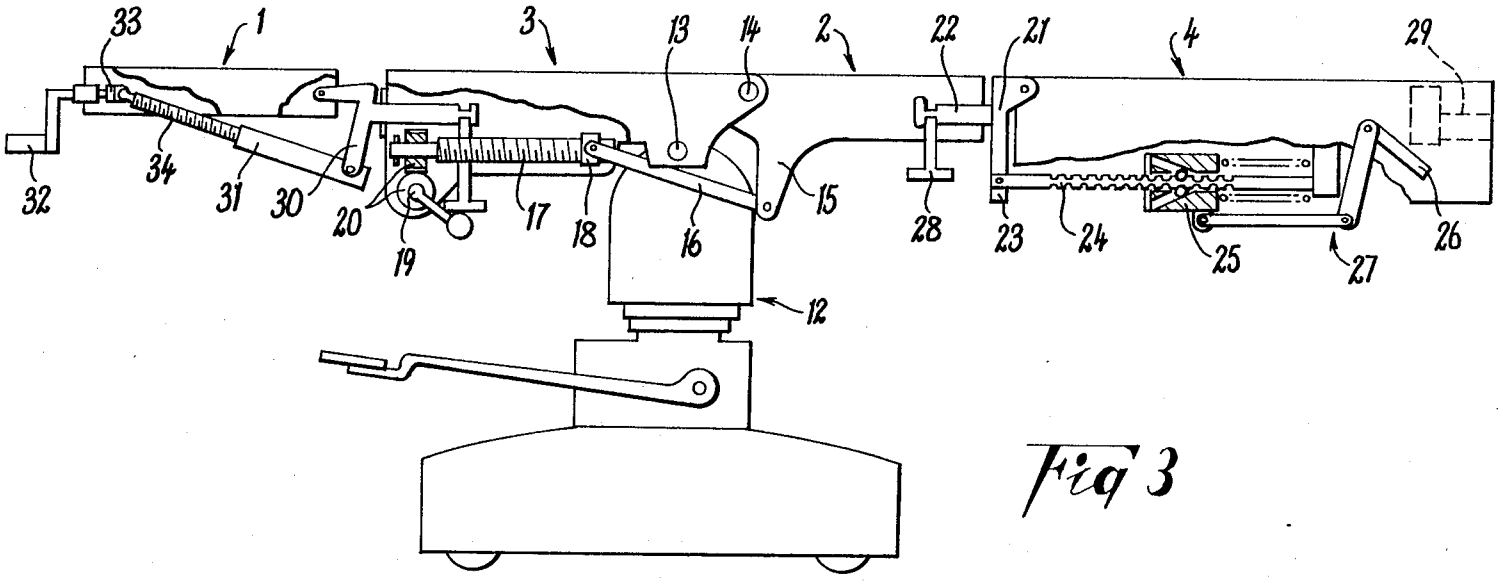
FIG. 3 shows a schematic side view of the operating table showing in simplified form the pivoting arrangements for the head, lower torso and leg sections and also showing the coupling means which enables detachment of the head and leg sections.

FIG. 3 shows a schematic side view of the operating table. The operating table is shown in its normal configuration with the head section 1 adjacent the upper torso section 3, which in its turn is adjacent the leg section 4. The upper torso portion 3 is pivotally mounted to the support column 12 by a transverse axis 13. The upper torso portion is independently pivotally mounted to the lower torso portion by a pivot axis 14. A drive means is provided for affecting pivotal movement of the lower torso portion relative to the upper torso portion. The drive means is arranged to provide a positive drive to both sides of the lower torso portion so the arrangement shown in FIG. 3 is repeated on the reverse side. The drive means comprises a pair of drive arms 15 which is linked to a drive mechanism on the upper torso portion by a drive link 16. The drive mechanism comprises two drive screws 17, a follower nut 18 on each drive screw pivotally connected to the drive links so that as the drive screws are turned the follower nuts travel along the drive links and the movement of the nuts is transmitted to the drive arms of the lower torso section 2 thus pivotally moving the lower torso section relatively to the upper torso section. The drive mechanism further comprises a drive shaft 19 extending transversely of the upper torso section 3 and coupled to the drive screws 17 by means of meshing helical gears 20 provided on the drive shaft and the respective drive screws.

The leg section 4 is provided with a locking mechanism for locking the leg section in a chosen angular position. The locking mechanism comprises two coupling brackets 21 pivotally mounted to the inner end of the side frame members of the leg section 4. Each coupling bracket further includes a coupling pin 22 adapted for engagement in complementary coupling holes provided in the lower torso section 2. Each coupling bracket further includes a downwardly extending arm 23 pivotally connected to a locking shaft 24. The locking shaft is adapted to be held in a particular angular position by a holding block 25 which is slidable relative to the locking shaft 24. The holding block includes a pair of holding rollers which are moved in respective angled tracks provided in the holding blocks, the angled tracks being inclined towards the locking shaft so that the weight of the leg section tends to force the blocks along the locking shaft towards the pivoted end whereby the holding rollers are forced by the outer surfaces of the angled tracks towards the locking shaft and into the grooves provided therein. The locking means is releasable by a release means comprising a release arm 26 which is coupled to a linkage arrangement 27 to the holding block 25. The leg section is releasable from the lower torso portion by removal of a retaining pin 28. The head section 1 may be attached to the leg section 4 in a different configuration by means of a coupling hole 29 in each of the side frame members of leg section 4.

The head section 1 is also adapted for independent pivotal movement. The head section pivoting mechanism includes a downwardly extending arm 30 being mounted against movement relative to the upper torso section. The downwardly extending arm has a nut tube 31 pivotally connected thereto at its lower end. A screw threaded shaft 34 extends generally towards the longitudinally outermost end of the head section and is drivable by an operating handle 32 projecting from the outermost end of the head section, the operating handle being coupled to the screw threaded shaft through a universal joint 33.

Figure 4:
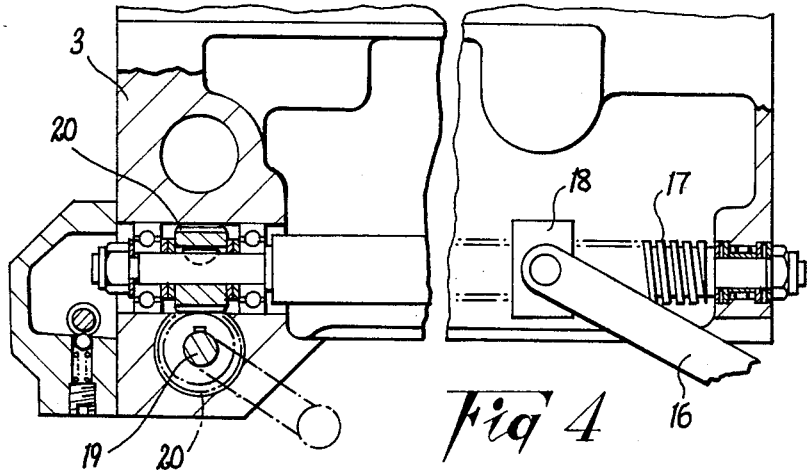
FIG. 4 is a side sectional view of a portion of the side frame member of the upper torso section in which the drive means for the pivotal movement of the lower torso section relative to the upper torso section is illustrated.

FIG. 4 which is a partial side sectional view of the side frame member of the upper torso section shows in detail the drive means for pivotal movement of the lower torso section relative to the upper torso section. Numerals used are the same for the corresponding parts shown in FIG. 3.

Finally, it is to be understood that various alterations, modifications, and/or additions may be made to the constructions and arrangement of parts as herein described without departing from the spirit and scope of the present invention.

Having now described my invention what I claimed as new and desired to secure by Letters Patent is:

1. An operating table having first and second ends including a support structure, an elongate table top mounted on said support structure and having a longitudinal axis, said table top being composed of a first transferable section, an upper torso section, a lower torso section and a second transferable section, each of said sections having two opposite end edges extending transverse to said longitudinal axis, the sections being arranged adjacent to each other along said longitudinal axis in edge to edge relationship, the adjacent edges of each two adjacent sections extending transverse of said longitudinal axis of said table top and each said section being movable relative to its adjacent section about an axis also extending transverse to said longitudinal axis, said first transferable section being normally located at said first end of said table, first releasable connecting means connecting said first transferable section to said upper torso section, said second transferable section being normally located at said second end of said table top and having an inner end and an outer end, a second releasable connecting means for connecting the inner end of said second transferable section to said lower torso section, and further connecting means at the outer end of said second transferable section whereby said first transferable section can be selectively releasably mounted to the outer end of said second transferable section, said second transferable section being positionable at said first end of said table, said second transferable section including two generally parallel side frame members having inner and outer ends and defining an open space between them for passage of radiation, a surface plate mounted to the parallel side frame members and which is substantially transparent to radiation and which provides a top surface of the second transferable section of the table top, the inner ends of the second transferable section side frame members of the operating table being normally mounted to the lower torso section, the outer ends of the second transferable section side frame members being connected by a radiolucent cross-piece so that the second transferable section provides a continuous radiolucent area between the side frame members thereof and extending from the inner end to the outer end of the second transferable section.

2. An operating table as claimed in claim 1 wherein the upper torso section is pivotally mounted to an upper portion of the support structure about a generally longitudinal axis and independently about a generally transverse axis, the remaining said sections of the table top being mounted directly or indirectly to the upper torso section so that movement of the section about either of the pivoting axes moves the entire table top about the respective axis.

3. An operating table as claimed in claim 1 wherein the first transferable section comprises a generally U-shaped frame composed of two side frame members and a base, the base being at the longitudinally outermost end of the first transferable section and the two side frame members and the base defining an open space between them enabling passage of radiation between the side frame members and the table.

4. An operating table as claimed in claim 1 wherein the upper torso section includes two generally parallel side frame members defining an open space between enabling passage of radiation between the side frame members, the upper torso section further including a radiolucent surface plate mounted to the side frame members to define the top surface of the upper torso section, the first transferable section in a normal configuration of the operating table being connected to the outer ends of the side frame members of the upper torso section, the inner ends of the side frame members of the upper torso section being pivotally connected to the support structure.

5. An operating table as claimed in claim 1 wherein the lower torso section comprises two generally parallel side frame members defining an open space between them for passage of radiation, the inner ends of the parallel side frame members of the lower torso section being pivotally mounted to the upper torso section, the outer ends of the side frame members of the lower torso section being connected by a radiolucent crosspiece arranged to provide a degree of torsional stability to the lower torso section and enabling the entire length of the lower torso section between the parallel side frame members thereof to be made radiolucent.

6. An operating table as claimed in claim 5 wherein the radioluscent cross-piece is in the form of a slat having opposed broad surfaces which are generally vertical when the table top is generally horizontal.

7. An operating table as claimed in claim 5 and further including drive means for effecting pivotal movement of the lower torso section relative to the upper torso section, the drive means being arranged to provide a positive drive to both sides of the lower torso section so that the table top has sufficient torsional stability in its modified configuration.

8. An operating table as claimed in claim 6 wherein the drive means comprises a pair of drive arms, each drive arm extending downwardly from a respective side frame member of the lower torso section below on axis of pivotal connection of the lower torso section to the upper torso section, the drive means further including a drive mechanism provided on the upper torso section and arranged to move the drive arms about the pivot axis.

9. An operating table as claimed in claim 8 wherein the drive mechanism on the upper torso section includes two drive screws mounted in bearings at respective sides of the upper torso section, a follower nut on each drive screw, two drive links arranged so that each follower nut is drivably coupled to the respective drive arm of the lower torso section, the drive links being pivotally connected to the respective follower nuts and to the respective drive arms so that as the drive screws are turned, the follower nuts travel along the drive screws and a movement of the nuts is transmitted to the drive arms of the lower torso section thus pivotally moving the lower torso section relative to the upper torso section, a drive shaft extending transversely of the upper torso section and coupled to the drive screws by means of meshing helical gears provided on the drive shaft and the respective drive screws so that as the drive shaft is rotated the drive screws are turned.

10. An operating table as claimed in claim 9 wherein the outer end of the second transferable section is provided with a pair of coupling holes for receiving coupling pins constituting part of coupling means of the first transferable section, the coupling means of the first transferable section being of substantially the same configuration as the coupling means of the second transferable section whereby the first transferable section may be releasably coupled to the second transferable section, to the upper torso section and to the lower torso section and the second transferable section can be releasably coupled to the lower torso section or to the upper torso section.

11. An operating table as claimed in claim 1 wherein the first transferable section includes a pivoting mechanism for enabling independent pivoting movement of the first transferable section relative to the adjacent section, the first transferable section pivoting mechanism including a downwardly extending arm at one side of the first transferable section, the downwardly extending arm being normally mounted against movement relative to the upper torso section, the lower end of the downwardly extending arm having a nut tube pivotally connected thereto with the nut tube extending generally towards the longitudinally outermost end of the first transferable section, a screw threaded shaft which is engaged with the nut tube and which is drivable by an operating handle projecting from the outermost end of the first transferable section, the operating handle being coupled to the screw threaded shaft through a universal joint to allow limited angular movement of the screw threaded shaft relative to the operating handle, the arrangement being such that turning of the operating handle moves the screw threaded shaft into or out of the nut tube and thus pivots the first transferable section relative to the adjacent section of the table.

12. An operating table having first and second ends including a support structure, an elongate table top mounted on said support structure and having a longitudinal axis, said table top being composed of a first transferable section, an upper torso section, a lower torso section and a second transferable section, each of said sections having two opposite end edges extending transverse to said longitudinal axis, the sections being arranged adjacent to each other along said longitudinal axis in edge to edge relationship, the adjacent edges of each two adjacent sections extending transverse of said longitudinal axis of said table top and each said section being movable relative to its adjacent section about an axis also extending transverse to said longitudinal axis, said first transferable section being normally located at said first end of said table, first releasable connecting means connecting said first transferable section to said upper torso section, said second transferable section being normally located at said second end of said table top and having an inner end and an outer end, a second releasable connecting means for connecting the inner end of said second transferable section to said lower torso section, further connecting means at the outer end of said second transferable section whereby said first transferable section can be selectively releasably mounted to the outer end of said second transferable section, said second transferable section being positionable at said first end of said table, said lower torso section comprising two generally parallel side frame members defining an open space between them for passage of radiation, the inner ends of the parallel side frame members of the lower torso section being pivotally mounted to the upper torso section, the outer ends of the side frame members of the lower torso section being connected by a radiolucent cross-piece arranged to provide a degree of torsional stability to the lower torso section and enabling the entire length of the lower torso section between the parallel side frame members thereof to be made radiolucent, said radiolucent cross-piece being in the general form of a slat having opposed broad surfaces which are generally vertical when the table top is generally horizontal, and drive means for effecting pivotal movement of the lower torso section relative to the upper torso section, the drive means being arranged to provide a positive drive to both sides of the lower torso section so that the table top has sufficient torsional stability in its modified configuration, said drive means comprising a pair of drive arms, each drive arm extending downwardly from a respective side frame member of the lower torso section below the axis of pivotal connection of the lower torso section to the upper torso section, the drive means further including a drive mechanism provided on the upper torso section and arranged to move the drive arms about the pivot axis, said drive mechanism on the upper torso section including two drive screws mounted in bearings at respective sides of the upper torso section, a follower nut on each drive screw, two drive links arranged so that each follower nut is drivably coupled to the respective drive arm of the lower torso section, the drive link being pivotally connected to the respective follower nuts and to the respective drive arms so that as the drive screws are turned, the follower nuts travel along the drive screws and the movement of the nuts is transmitted to the drive arms of the lower torso section thus pivotally moving the lower torso section relative to the upper torso section, a drive shaft extending transversely of the upper torso section and coupled to the drive screws by means of meshing helical gears provided on the drive shaft and the respective drive screws so that as the drive shaft is rotated the drive screws are turned, said drive shaft being transversely movable between two laterally spaced operative positions in one of which positions the helical gears provided on the drive shaft mesh with the gears for the drive screws of the lower torso section drive mechanism and in the other operative position the helical gears are operative to transmit drive to a mechanism for pivoting the upper torso section about the support structure whereby the drive shaft can be used for effecting pivotal movement of the upper torso section relative to the support structure and for effecting pivotal movement of the lower torso section relative to the upper torso section.

13. An operating table having first and second ends including a support structure, an elongate table top mounted on said support structure and having a longitudinal axis, said table top being composed of a first transferable section, an upper torso section, a lower torso section and a second transferable section, each of said sections having two opposite end edges extending transverse to said longitudinal axis, the sections being arranged adjacent to each other along said longitudinal axis in edge to edge relationship, the adjacent end edges of each two adjacent sections extending transverse of said longitudinal axis of said table top and each said section being movable relative to its adjacent section about an axis also extending transverse to said longitudinal axis, said first transferable section being normally located at said first end of said table, first releasable connecting means connecting said first transferable section to said upper torso section, said second transferable section being normally located at said second end of said table top and having an inner end and an outer end, a second releasable connecting means for connecting the inner end of said second transferable section to said lower torso section, further connecting means at the outer end of said second transferable section whereby said first transferable section in a modified configuration of the operating table can be selectively releasably mounted to the outer end of said second transferable section, said second transferable section being positionable at said first end of said table, said lower torso section comprising two generally parallel side frame members having inner and outer ends and defining an open space between them for passage of radiation, the inner ends of the parallel side frame members of the lower torso section being pivotally mounted to the upper torso section, the outer ends of the side frame members of the lower torso section being connected by a radiolucent cross-piece arranged to provide a degree of torsional stability to the lower torso section and enabling the entire length of the lower torso section between the parallel side frame members thereof to be made radiolucent, said radiolucent cross-piece being in the general form of a slat having opposed broad surfaces which are generally vertical when the table top is generally horizontal, and drive means for effecting pivotal movement of the lower torso section relative to the upper torso section, the drive means being arranged to provide a positive drive to both sides of the lower torso section so that the table top has sufficient torsional stability in its said modified configuration.

14. An operating table having first and second ends including a support structure, an elongate table top mounted on said support structure and having a longitudinal axis, said table top being composed of a first transferable section, an upper torso section, a lower torso section and a second transferable section, each of said sections having two opposite end edges extending transverse to said longitudinal axis, the sections being arranged adjacent to each other along said longitudinal axis in edge to edge relationship, the adjacent end edges of each two adjacent sections extending transverse of said longitudinal axis of said table top and each said section being movable relative to its adjacent section about an axis also extending transverse to said longitudinal axis, said first transferable section being normally located at said first end of said table, first releasable connecting means connecting said first transferable section to said upper torso section, said second transferable section being normally located at said second end of said of said table top and having an inner end and an outer end, a second releasable connecting means for connecting the inner end of said second transferable section to said lower torso section, further connecting means at the outer end of said second transferable section whereby said first transferable section can be selectively releasably mounted to the outer end of said second transferable section, said second transferable section being positionable at said first end of said table in place of said first transferable section, said second transferable section including two generally parallel side frame members having inner and outer ends and defining an open space between them for passage of radiation, a surface plate mounted to the parallel side frame members and which is substantially transparent to radiation and which provides a top surface of the second transferable section of the table top, the inner ends of the second transferable section side frame members of the operating table being normally mounted to the lower torso section, the outer ends of the second transferable section side frame members being connected by a radiolucent cross-piece so that the second transferable section provides a continuous radiolucent area between the side frame members thereof and extending from the inner end to the outer end of the second transferable section, and a locking mechanism at each side of the second transferable section, the locking mechanism being operative to positively lock the second transferable section in a chosen angular position relative to the lower torso section in a normal configuration of the table, the locking mechanism being operable to enable pivoting of the second transferable section relative to the lower torso section, the locking mechanism including two coupling brackets, each of which has an upper end, each coupling bracket being pivotally mounted at its said upper end to the inner end of a respective second transferable section side frame member, the locking mechanism further including two coupling pins, each coupling pin extending from a respective one of the two coupling brackets and for engagement in complementary coupling holes provided in the lower torso section, each coupling bracket further including a downwardly extending arm to which is pivotally connected a locking shaft which extends generally in a longitudinal direction beneath the respective second transferable section side frame member, the locking mechanism further including a holding member operative to positively hold each said locking shaft to thereby lock the second transferable section in a particular angular position.

15. An operating table as claimed in claim 14 wherein the holding member comprises a holding block which is slidable relative to the locking shaft, the locking shaft extending through the holding block.

16. An operating table as claimed in claim 15 wherein the locking shaft is provided with a plurality of circumferential grooves or necked portions provided along a substantial portion of the length thereof, the grooves being arranged to be engaged by the holding member to lock the second transferable section in a particular angular configuration.

17. An operating table as claimed in claim 16 in which the holding member further includes a pair of holding rollers which are movable in respective angled tracks provided in the holding block, the angled tracks being inclined towards the locking shaft and away from the end of the second transferable section which is normally connected to the lower torso section so that the weight of the second transferable section tends to force the block along the locking shaft towards the pivoted end whereby the holding rollers are forced by the outer surfaces of the angled tracks towards the locking shaft and into the grooves provided therein.

18. An operating table as claimed in claim 17 and further including a release means provided at the sides of the second transferable section, the release means being coupled to a linkage arrangement which is also operatively coupled to the holding block, the release means being operable to draw the holding block back so that the inner surfaces of the angled tracks engage with the rollers to move them along the tracks away from the locking shaft thereby releasing the locking shaft and enabling pivotal movement of the second transferable section relative to the lower torso section.

19. An operating table as claimed in claim 18 wherein the second transferable section includes coupling means enabling selective disengagement of the second transferable section from the lower torso section, the coupling means comprising a pair of coupling pins, one at each side of the second transferable section and which are arranged to fit into complementary coupling holes provided in a longitudinal end face of the lower torso section, the coupling pins being located at the sides of the second transferable section so that no intrusion into the radiolucent space between the side frame members of the lower torso or second transferable sections occurs.

* * * * *